US007361859B2

(12) United States Patent
Yoshioka et al.

(10) Patent No.: US 7,361,859 B2
(45) Date of Patent: Apr. 22, 2008

(54) KEY SHEET

(75) Inventors: Toshikazu Yoshioka, Tokyo (JP); Akira Senzui, Tokyo (JP)

(73) Assignee: Polymatech Co. Ltd., Tokyo (JP)

( * ) Notice: Subject to any disclaimer, the term of this patent is extended or adjusted under 35 U.S.C. 154(b) by 0 days.

(21) Appl. No.: 11/730,418

(22) Filed: Apr. 2, 2007

(65) Prior Publication Data

US 2007/0235296 A1 Oct. 11, 2007

(30) Foreign Application Priority Data

Apr. 3, 2006 (JP) ..... 2006-102574

(51) Int. Cl.
*H01H 13/70* (2006.01)

(52) U.S. Cl. ..... 200/341

(58) Field of Classification Search ..... 29/622; 200/5 A, 512, 517, 341; 341/22; 345/168–170, 345/268; 400/472
See application file for complete search history.

(56) References Cited

U.S. PATENT DOCUMENTS 6,967,292 B2 * 11/2005 Nishimura ..... 200/5 A
6,977,352 B2 * 12/2005 Oosawa ..... 200/314
6,993,830 B2 * 2/2006 Shimizu et al. ..... 29/622
7,027,036 B2 * 4/2006 Yang ..... 345/170
7,034,235 B2 * 4/2006 Hosaka ..... 200/314
7,099,465 B2 * 8/2006 Nishi ..... 379/433.07
7,262,379 B2 * 8/2007 Nishimura et al. ..... 200/314

FOREIGN PATENT DOCUMENTS

JP 11-144547 A 5/1999
JP 2004-327417 A 11/2004

* cited by examiner

*Primary Examiner*—Michael A Friedhofer
(74) *Attorney, Agent, or Firm*—Rader, Fishman & Grauer PLLC

(57) ABSTRACT

Disclosed is a thin key sheet that is relatively free from breakage due to depressing operation. When key tops are depressed, float-supporting portions of rubber moldings and a film sheet undergo deformation, and a depression load can be borne by both the float-supporting portions and the film sheet, so the load on the float-supporting portions is mitigated, making the float-supporting portions less subject to breakage. Further, since the film sheet exists between the rubber moldings and a resin plate, it is possible to prevent the rubber moldings from being rubbed against a side wall of a frame portion, making it possible to prevent breakage due to rubbing between the rubber moldings and the resin plate.

12 Claims, 8 Drawing Sheets

KEY SHEET

BACKGROUND OF THE INVENTION

1. Field of the Invention

The present invention relates to a pushbutton switch key sheet for use in operating portions of various electronic apparatuses, such as a mobile phone, a PDA, a car navigation apparatus, and a car audio apparatus, and more particularly, to a key sheet in which a plurality of key tops are exposed through an operational opening having no partition frame formed in a casing of an electronic apparatus.

2. Description of the Related Art

For example, for use in a mobile phone (1), there is known, as shown in FIG. 12, a pushbutton switch in which, for a reduction in size of an operating portion and an improvement in terms of an artistic design of the pushbutton switch, a plurality of key tops (4) of a key sheet (3) are exposed in a dense state through an operational opening (2*a*) with no partition frame, which is formed in a casing (2). The number of key tops (4) are seventeen in total, an interval between the adjacent key tops (4) is very small, for example, the interval is set to approximately 0.15 mm to 0.2 mm, and a clearance between the key tops (4) and the operational opening (2*a*) is also set to a very small dimension.

As shown in FIG. 13, in the conventional key sheet (3), the key tops (4) are fixed to a surface of a base sheet (5) constituting an operating surface. The base sheet (5) is equipped with base portions (6) which are formed of silicone rubber and to which the key tops (4) are fixed, and a reinforcing plate (7) formed of a hard resin. Thus, due to rigidity of the reinforcing plate (7), it is possible to suppress general distortion of the key sheet (3) if the key sheet (3) is set upright or tilted during use of the mobile phone (1). Such a conventional key sheet is disclosed, for example, in JP 2004-327417 A.

The base portions (6) are composed of pedestal portions (6*a*) to which the key tops (4) are fixed and flexible portions (6*b*) elastically supporting the pedestal portions (6*a*). As depressing operation is repeatedly performed on the key tops (4), there is a fear of the flexible portions (6*b*) suffering breakage due to bending fatigue. For example, in a portable electronic apparatus of which a reduction in thickness is urgently required, a thickness of each component has been considerably reduced, and the flexible portions (6*b*) are also as thin as approximately 0.2 mm, which means they are subject to breakage.

The fixation of each key top (4) to the corresponding pedestal portion (6*a*) is effected by applying adhesive to one of them. At this time, the adhesive squeezed out of an interface between the key top (4) and the pedestal portion (6*a*) may adhere to the flexible portion (6*b*). In the flexible portions (6*b*), which are very thin as stated above, portions thereof to which the adhesive adheres cease to be deformed, which leads to one-sided expansion in these areas, resulting in breakage of the flexible portions (6*b*).

SUMMARY OF THE INVENTION

The present invention has been made in view of the above-mentioned problems in the prior art. It is therefore an object of the present invention to provide a thin key sheet relatively free from breakage due to depressing operation.

In order to achieve the above-mentioned object, the present invention is structured as described below. That is, the present invention provides a key sheet including: a key top; and a base sheet having a support member formed of a rubber-like elastic material and including a fixation portion for the key top and a float-supporting portion allowing depression displacement of the key top, and a reinforcing member supporting the support member and formed like a thin board of a hard material, characterized in that the float-supporting portion is equipped with a flexible protective layer.

According to the present invention, the float-supporting portion allowing the depression displacement of the key top is equipped with the flexible protective layer. Thus, when depressing operation is performed on the key top, the protective layer undergoes deformation together with the float-supporting portion, which means a depression load can be borne by both the float supporting portion and the protective layer. Thus, the load on the float-supporting portion is mitigated, making the float-supporting portion relatively free from breakage.

In the key sheet of the present invention, the protective layer is interposed between the support member and the reinforcing member. Thus, when the key top is depressed, it is possible to prevent the float-supporting portion of the support member from being rubbed against the reinforcing member. Thus, it is possible to prevent breakage due to rubbing between the float-supporting portion and the reinforcing member.

The above-mentioned protective layer can be provided on at least one of a front surface and a back surface of the support member. According to the present invention, in an example of a case in which the protective layer is provided on the front surface of the support member, the protective layer is provided so as to cover the fixation portion of the support member. In the prior-art techniques, when fixing the key top to the base sheet, an adhesion method is selected taking into consideration a material of the base portion. For example, in a case of the base portion formed of silicone rubber as in a conventional example, surface quality modification has to be effected on the base portion, and a kind of adhesive that can be adopted is restricted. In contrast, according to the present invention, if the support member is formed of silicone rubber, the key top is fixed to the protective layer covering the surface of the support member, so there is no need for the surface quality modification, and a range of selection for the adhesive is widened. Thus, it is possible to fix the key top at lower cost and enhance fixation strength as compared with the conventional example. When the protective layer is provided on the back surface of the support member, it is possible to prevent the back surface of the support member from coming into contact with a board opposed thereto, so it is possible to prevent wear due to contact between the support member and the board.

In the key sheet of the present invention, the reinforcing member is provided with a frame portion supporting the float-supporting portion, and the support member is provided with a holding portion covering a side wall of the frame portion. That is, the holding portion exists between the reinforcing member and the float-supporting portion. Thus, when the key top is depressed, it is possible to prevent the float-supporting portion from being rubbed against the side wall of the frame portion of the reinforcing member. Thus, it is possible to prevent breakage due to rubbing between the float-supporting portion and the reinforcing member.

In the key sheet of the present invention, the protective layer is formed of a soft resin, so, when the key top is depressed, the protective layer undergoes deformation together with the float-supporting portion; however, it is possible to minimize an increase in depression load. Thus, it is possible to realize the same operability as when no protective layer is provided.

In the key sheet of the present invention, the protective layer is formed of a thermoplastic resin, so the protective layer can be softened by heating treatment or heating/pressurizing treatment. Thus, when the support member is molded with the protective layer inserted in the mold, the surface of the protective layer in contact with the support member is softened or melted by the heat and pressure at the time of molding, making it possible to integrate the protective layer with the support member simultaneously with the molding of the support member.

According to the present invention, in the above-mentioned key sheet using the protective layer formed of thermoplastic resin, the key top formed of a thermoplastic resin is fixed through softening or melting to the protective layer covering the surface of the fixation portion. Since it is possible for members formed of the thermoplastic resin to be fixed to each other through softening or melting by heating treatment or heating/pressurizing treatment, they can be fixed to each other more firmly than in the case of fixation by adhesive. For example, the heating/pressurizing treatment can be effected easily by using ultrasonic waves, so the fixation of the key top and the protective layer can be realized easily. Further, since no adhesive is used, there is no fear of adhesive adhering to the float-supporting portion. Thus, the float-supporting portion does not easily suffer breakage. In a case in which the key top and the protective layer are to be fixed to each other in a softened or melted state, they are formed of materials having compatibility in the softened or melted state. As the materials having compatibility, it is possible, for example, to use the same kind of thermoplastic resin, or thermoplastic resins which, if of different kinds, allow fixation through softening or melting.

In the key sheet of the present invention, the key top is fixed to the support member or the protective layer by an adhesion layer to be softened or melted by heating. The adhesion layer formed, for example, of a hot-melt adhesive, which is softened or melted by heating, can be provided through thermal transfer in conformity with an adherend area and an adherend configuration of an adherend. Thus, it is possible to provide the adhesion layer in conformity with a fixation area and a fixation configuration of the key top, making it possible to prevent adhesion of any squeezed-out portion of the adhesion layer to the float-supporting portion. Thus, no one-sided deformation is generated in the expandable float-supporting portion, making the float-supporting portion relatively free from breakage.

In the key sheet of the present invention, when the key top is depressed, the protective layer undergoes deformation together with the float-supporting portion, and the depression load can be borne by both the float-supporting portion and the protective layer. Thus, the load on the float-supporting portion is mitigated, making the float-supporting portion relatively free from breakage. Thus, breakage due to depression does not easily occur. Thus, it is possible to meet the requirement for a reduction in the size and thickness of electronic apparatuses, which proves the present invention particularly suitable for portable electronic apparatuses.

The above description of the present invention should not be construed restrictively. The advantages, features, and uses of the present invention will become more apparent from the following description given with reference to the accompanying drawings. Further, it should be understood that all modifications made without departing from the gist of the present invention are to be covered by the scope of the present invention.

DESCRIPTION OF THE PREFERRED EMBODIMENTS

Figure 1:
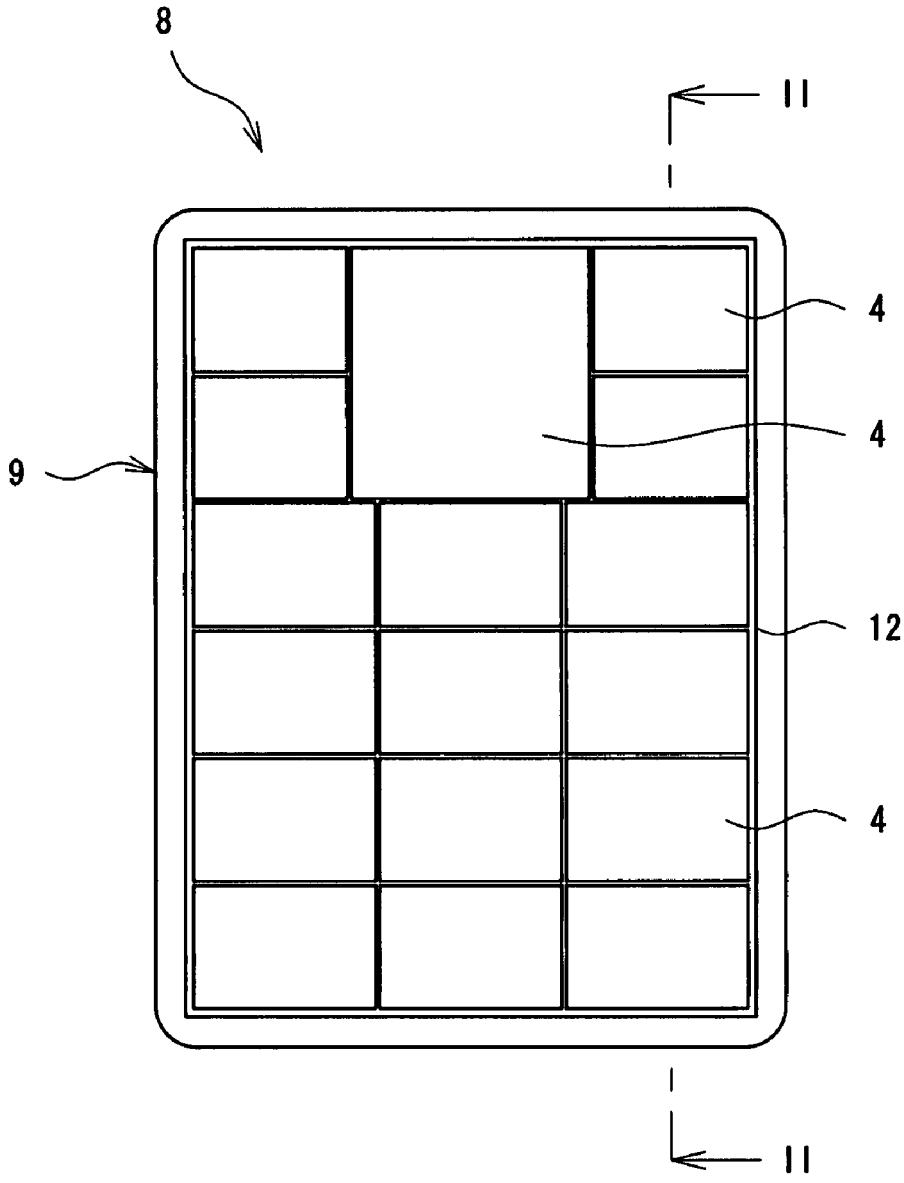
FIG. 1 is a plan view of a key sheet according to a first embodiment of the present invention.

In the following, embodiments of the present invention will be described with reference to the drawings. In the drawings, the reference numerals indicate portions and components of the embodiments. The portions and components common to the embodiments are indicated by the same reference numerals, and a redundant description thereof will be omitted.

In the following embodiments, the present invention is applied to a key sheet to be incorporated into the casing (2) of a mobile phone (1) as the "electronic apparatus" as in the prior-art technique. In particular, the present invention will be described as applied to a so-called "small-interval type key sheet", in which a plurality of key tops are exposed through an operational opening with no partition frame formed in the casing (2) of the mobile phone (1).

Figure 2:
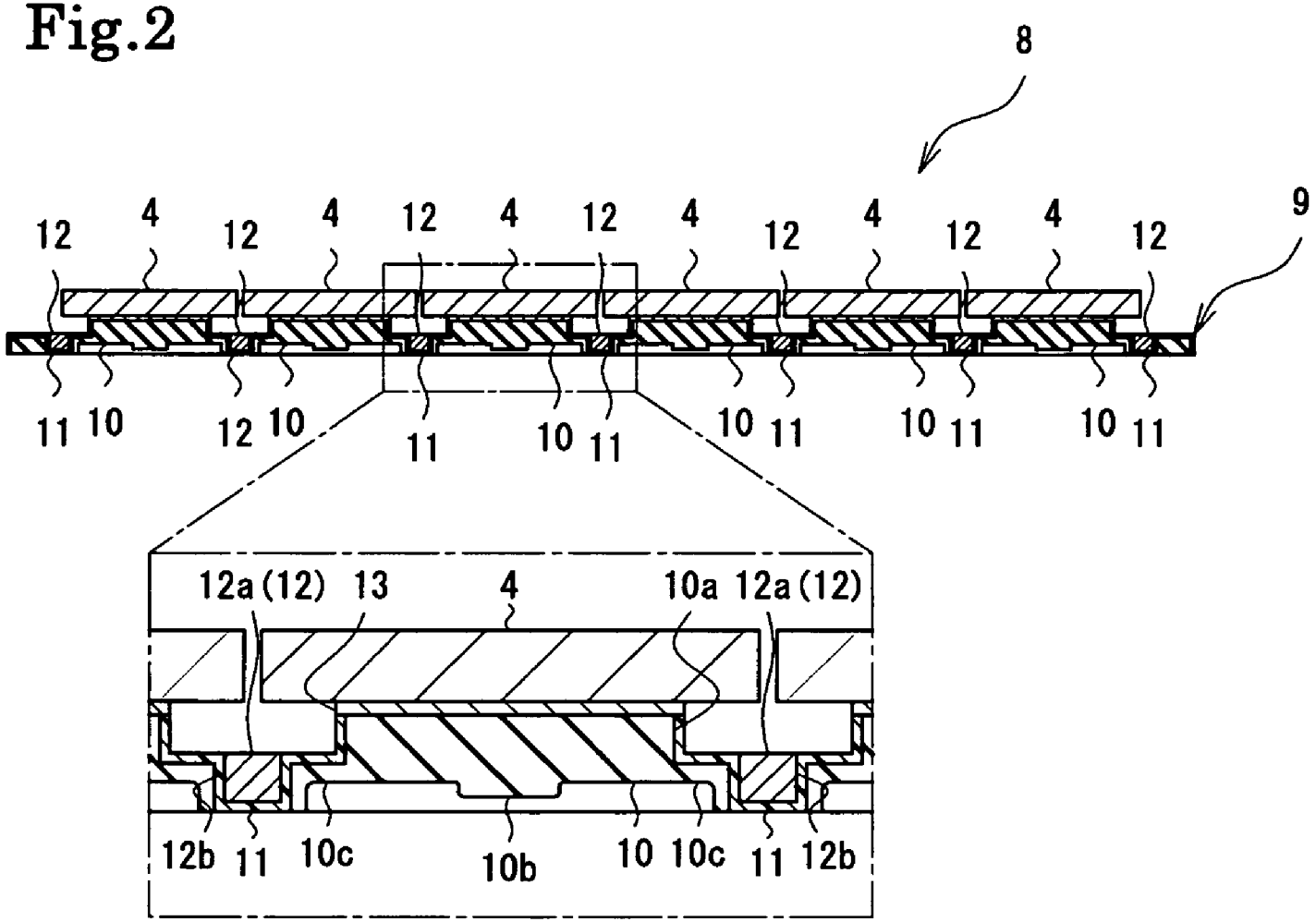
FIG. 2 is a sectional view taken along the line II-II of FIG. 1.

First Embodiment (FIGS. 1 and 2)

A key sheet (8) according to the first embodiment is composed of key tops (4) formed of a polycarbonate resin and a base sheet (9) to which the key tops (4) are fixed. The base sheet (9) is equipped with rubber moldings (10) as the "support members", a film sheet (11) as the "protective layer", and a resin plate (12) as the "reinforcing member".

The rubber moldings (10) are formed of silicone rubber, and are formed separately for each key top (4). Pedestal portions (10*a*) as the "fixation portions" for the key tops (4) protrude from the operating-surface-side surfaces of the rubber moldings. On the opposite side, that is, on the back side thereof, there are provided pusher portions (10*b*) for depressing opposed contact switches (not shown). Around the pedestal portions (10*a*), there are formed float-supporting portions (10*c*) allowing depression displacement of the key tops (4) and the pedestal portions (10*a*). The key tops (4) are fixed to the top surfaces of the pedestal portions (10*a*) of the rubber moldings (10) by means of adhesion layers (13) formed by applying thereto an adhesive composed of an ultraviolet curing type resin. Instead of causing the pedestal portions (10*a*) to protrude, it is also possible to form the surfaces of the rubber moldings as flat surfaces, using, as the "fixation portions", the portions of the rubber moldings (10) to which protrusions from the back surfaces of the key tops (4) are fixed.

The film sheet (11) is formed of an urethane type thermoplastic soft resin. The film sheet (11) covers the surfaces of the rubber moldings (10) except for the surface portions thereof where the key tops (4) are fixed, connecting the separated rubber moldings integrally with each other.

The resin plate (12) is formed of a hard resin, and has through-holes (12*b*) formed by a lattice-like frame portion (12*a*). The through-holes (12*b*) are closed by the rubber moldings (10), and the film sheet (11) is fixed to the side wall and the back side of the frame portion (12*a*).

Here, the materials of the components of the key sheet (8) of this embodiment will be described. The following description also applies to the other embodiments described below.

It is desirable for the material of the "rubber-like elastic member" to be a rubber of high rebound resilience or thermoplastic elastomer. Examples of the rubber that can be used include natural rubber, silicone rubber, ethylene propylene rubber, butadiene rubber, isoprene rubber, chloroprene rubber, and urethane rubber, and examples of the thermoplastic elastomer that can be used include a styrene type thermoplastic elastomer, an olefin type thermoplastic elastomer, an ester type thermoplastic elastomer, a urethane type thermoplastic elastomer, an amide type thermoplastic elastomer, a butadiene type thermoplastic elastomer, an ethylene-vinyl-acetate type thermoplastic elastomer, a fluoro-rubber type thermoplastic elastomer, an isoprene type thermoplastic elastomer, and a chlorinated polyethylene type thermoplastic elastomer. Of those rubber-like elastic materials, from the viewpoint of durability, the styrene type thermoplastic elastomer and the ester type thermoplastic elastomer are preferable. Taking its low temperature dependence into consideration, silicone rubber is preferable. In the case of silicone rubber, use of an addition-setting type one, in which an organosilicon compound having aromatic rings and nitrogen atoms is mixed, facilitates the adhesion to the film sheet (11).

It is desirable for the material of the "protective layer" to be one which, if thin, is of high tensile strength. Examples of the resin, which is to be used singly or in the form of a composite material, include a polyethylene resin, a polypropylene resin, a polyamide resin, a polyvinyl chloride resin, a polycarbonate resin, an acrylonitrile-butadiene-styrene resin, a polyethylene terephthalate resin, a polybutylene terephthalate resin, a polyphenylene oxide resin, a polyphenylene sulfide resin, a polyurethane resin, a polyphenylene ether resin, a modified polyphenylene ether resin, a polyketone resin, and a liquid crystal polymer. Of those, the polyamide resin, the polyurethane resin, the polyvinyl chloride resin, etc., which are relatively thin and flexible and free from breakage, are preferable as the "soft resin". In the case of a "thermoplastic resin", it is softened or melted by heating, allowing firm fixation to other members.

It is desirable for the material of the "hard resin" to be a thermoplastic resin or a reactive curing resin from the viewpoint of the requisite performance such as mechanical strength and durability, and a reduction in weight. Examples of the resin to be used include the polycarbonate resin, a polymethyl methacrylate resin, the polypropylene resin, a polystyrene resin, a polyacryl copolymer resin, a polyolefin resin, the acrylonitrile-butadiene-styrene resin, a polyester resin, an epoxy resin, the polyurethane resin, the polyamide resin, and a silicone resin. Of those hard resins, from the viewpoint of workability, the polycarbonate resin, the polymethyl methacrylate resin, the polyacryl copolymer resin, and the acrylonitrile butadiene styrene resin are preferable, and taking their high hardness into consideration, the polymethyl methacrylate resin, the polyacryl copolymer resin, and the epoxy resin are preferable. From the viewpoint of transparency, the polycarbonate resin, the polymethyl methacrylate resin, and the polyacryl copolymer resin are preferable.

Finally, the effects of the key sheet (8) of this embodiment will be described.

In the key sheet (8), when the key tops (4) are operated, the float-supporting portions (10*c*) of the rubber moldings (10) and the film sheet (11) undergo deformation, and the depression load can be borne by both the float-supporting portions (10*c*) and the film sheet (11). Thus, the load on the float-supporting portions (10*c*) is mitigated, making the float-supporting portions (10*c*) relatively free from breakage. Even if the key sheet is set upright or tilted, it is therefore possible to suppress distortion of the key sheet (8) due to the provision of the resin plate (12), and by virtue of the film sheet (11), the float-supporting portions (10*c*) do not easily suffer breakage caused by depressing operation.

Due to the presence of the film sheet (11) between the rubber moldings (10) and the resin plate (12), when the key tops (4) are depressed, it is possible to prevent the rubber moldings (10) from being rubbed against the side wall of the frame portion (12*a*) of the resin plate (12). Thus, it is possible to prevent breakage caused by rubbing of the rubber moldings (10) against the resin plate (12).

Since the film sheet (11) is formed of an urethane type soft resin, depression of the key tops (4) causes deformation of not only the float-supporting portions (10*c*) but also the film sheet (11); however, it is possible to minimize an increase in the depression load. Thus, it is possible to realize the same operability as when no film sheet (11) is provided.

Since the film sheet (11) is formed of a thermoplastic resin, the film sheet (11) can be softened by heating/pressurizing treatment. Thus, when forming the rubber moldings (10), by inserting the film sheet (11) in the mold, the surface of the film sheet (11) coming into contact with the rubber moldings (10) is softened or melted by the heat and pressure at the time of molding, making it possible to integrate the film sheet (11) with the rubber moldings (10) simultaneously with the molding of the latter.

Figure 3:
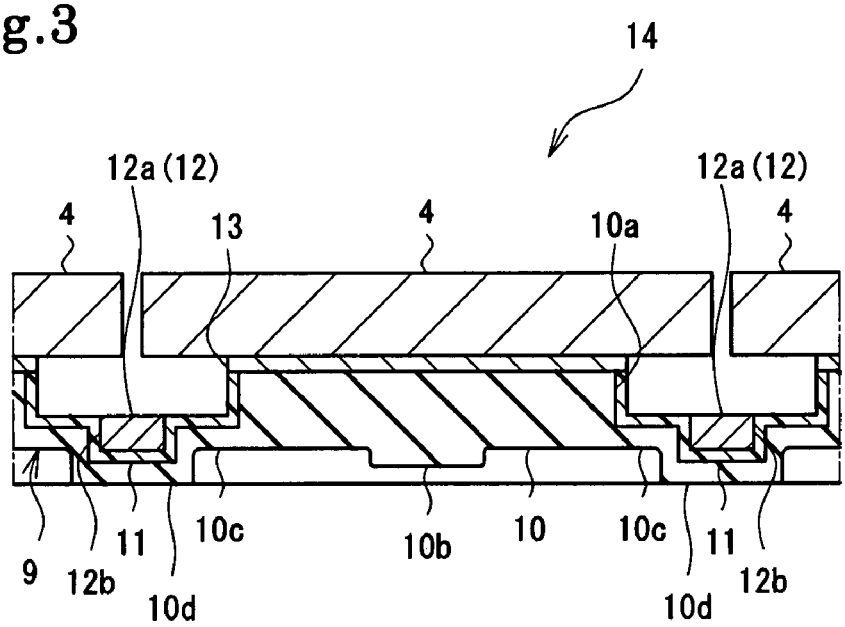
FIG. 3 is an enlarged main portion sectional view of a key sheet according to a second embodiment of the present invention.

Second Embodiment (FIG. 3)

A key sheet (14) according to the second embodiment differs from the key sheet (8) of the first embodiment in the construction of the rubber moldings (10). Otherwise, it is of the same construction and effects as the first embodiment.

The moldings (10) of this embodiment are provided with connecting portions (10*d*) for connecting together the rubber moldings (10), which are separated for each of the key tops (4) in the key sheet (8) of the first embodiment. The connecting portions (10*d*) are formed through the intermediation of the film sheet (11) portions fixed to the back surface of the frame portion (12*a*) of the resin plate (12).

The key sheet (14) of the second embodiment provides the same effects as those of the key sheet (8) of the first embodiment. Further, the key sheet (14) provides the following effects.

In the key sheet (14), the rubber moldings (10) are provided with the connecting portions (10*d*), so it is possible to increase the fixation area between the rubber moldings (10) and the film sheet (11). Thus, it is possible to increase the strength with which the moldings (10) and the film sheet (11) are fixed to each other.

Since the rubber moldings (10) are connected together by the connecting portions (10*d*), it is possible to form the rubber moldings (10) as a single sheet. Thus, as compared with the case in which the rubber moldings (10) are formed separately, they can be formed more easily.

Figure 4:
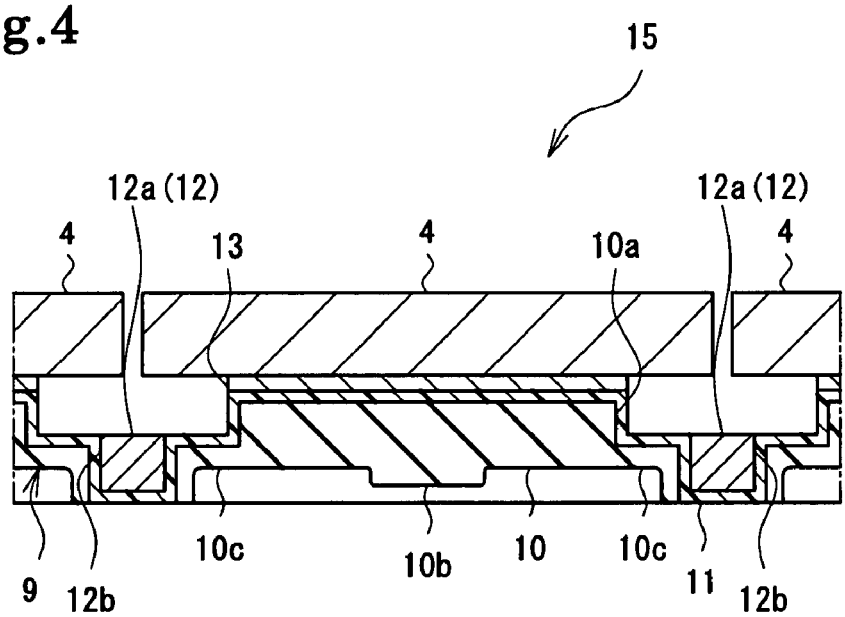
FIG. 4 is an enlarged main portion sectional view of a key sheet according to a third embodiment of the present invention.

Third Embodiment (FIG. 4)

A key sheet (15) according to the second embodiment differs from the key sheet (8) of the first embodiment in the construction of the film sheet (11). Otherwise, it is of the same construction and effects as the first embodiment.

The film sheet (11) also covers the surfaces of the pedestal portions (10*a*) of the rubber moldings (10) fixed to the key tops (4). That is, the film sheet (11), formed of a urethane type resin, covers the entire surfaces of the rubber moldings (10) formed of silicone rubber.

The key sheet (15) of the third embodiment provides the same effects as those of the key sheet (8) of the first embodiment. Further, the key sheet (15) provides the following effects.

In the key sheet (15), the film sheet (11) covers the surfaces of the pedestal portions (10*a*) fixed to the key tops (4), so it is possible to increase the fixation area between the film sheet (11) and the rubber moldings (10). Thus, it is possible to enhance the strength with which the film sheet (11) and the rubber moldings (10) are fixed to each other.

Since the surface to which the key tops (4) are fixed consists of the film sheet (11) formed of a urethane type resin, so it is possible to use adhesion layers (13) formed of a hot-melt adhesive, which is softened or melted by heating. The hot-melt adhesive allows provision of the adhesion layers (13) in conformity with the fixation area and the fixation configuration of the key tops (4) through utilization of thermal transfer. Thus, it is possible to prevent adhesion of squeezed-out adhesive from the adhesion layers (13) to the float-supporting portions (10*c*), making the float-supporting portions (10*c*) relatively free from breakage. Further, unlike adhesion layers formed through application of liquid adhesive, the adhesion layers (13) formed of hot-melt adhesive do not trap air. Thus, when the key sheet (15) is illuminated by a backlight, the key tops (4) are illuminated uniformly without involving unevenness.

Figure 5:
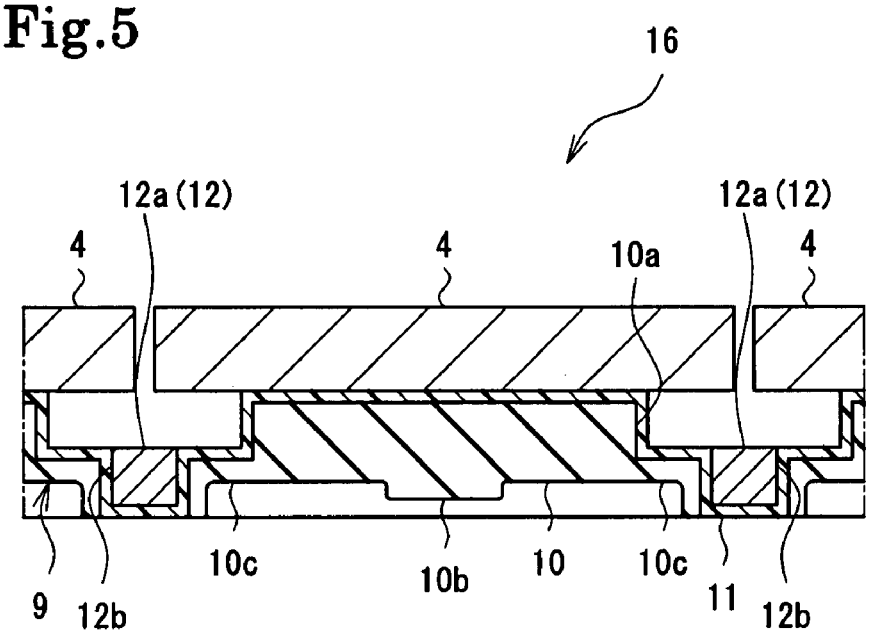
FIG. 5 is an enlarged main portion sectional view of a key sheet according to a fourth embodiment of the present invention.

Fourth Embodiment (FIG. 5)

A key sheet (16) according to the fourth embodiment differs from the key sheet (8) of the first embodiment in the construction of the film sheet (11). Otherwise, it is of the same construction and effects as the first embodiment.

The film sheet (11) is formed of a thermoplastic polycarbonate resin, and also covers, as in the third embodiment, the surfaces of the pedestal portions (10*a*) fixed to the key tops (4). As described below, the key tops (4) of this embodiment are fixed to the film sheet (11) of a polycarbonate resin through heating/pressurizing treatment, so unlike those of the above-mentioned embodiments, are formed of the polycarbonate resin.

The key sheet (16) of the fourth embodiment provides the same effects as those of the key sheet (8) of the first embodiment. Further, the key sheet (16) provides the following effects.

In the key sheet (16), the key tops (4) and the film sheet (11) are both formed of a thermoplastic polycarbonate resin, so they can be fixed to each other by softening or melting them through heating/pressurizing treatment. Thus, by adopting the ultrasonic fusion-bonding method, the key tops (4) and the film sheet (11) can be fixed to each other easily and more firmly than in the case of adhesive. Further, since no adhesive is used, there is no fear of adhesive adhering to the float-supporting portions (10*c*), thus making the float-supporting portions (10*c*) relatively free from breakage.

Figure 6:
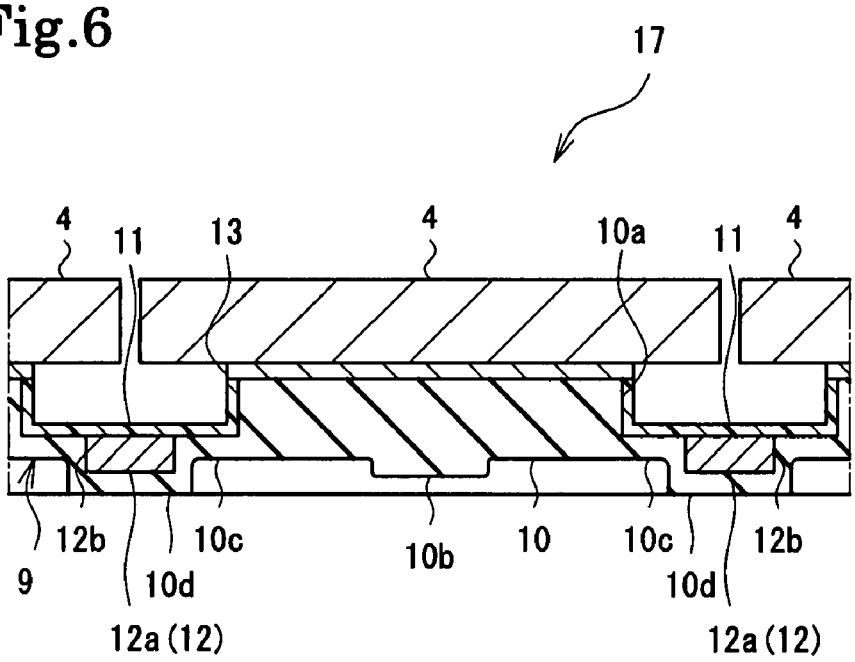
FIG. 6 is an enlarged main portion sectional view of a key sheet according to a fifth embodiment of the present invention.

Fifth Embodiment (FIG. 6)

A key sheet (17) according to the second embodiment differs from the key sheet (14) of the first embodiment in the construction of the film sheet (11). Otherwise, it is of the same construction and effects as the second embodiment.

The film sheet (11) covers the surface of the frame portion (12*a*) of the resin plate (12). That is, the front and back surfaces of the resin plate (12) are held by the film sheet (11) and the connecting portions (10*d*) of the rubber moldings (10), thus reducing the portion of the resin plate (12) exposed.

The key sheet (17) of the fifth embodiment provides the same effects as those of the key sheet (14) of the second embodiment. Further, the key sheet (17) provides the following effects.

In the key sheet (17), the resin plate (12) is not exposed, so it is possible to prevent the key tops (4), the casing (2) (not shown), or the board (not shown) from coming into contact with the resin plate (12). For example, when the surface of the resin plate (12) is exposed, depression of the key tops (4) may result in the key tops (4) colliding with the resin plate (12), which are both formed of a hard resin, thereby generating noise. In the fifth embodiment, however, the surface of the resin plate (12) is covered with the flexible film sheet (11), so the film sheet (11) buffers the collision between them like a cushion, making it possible to prevent generation of noise. On the other hand, the outer edge of the base sheet (9) is fixed between the casing (2) and the board in a compressed state. When, for example, the front surface or the back surface of the resin plate (12) is exposed, operation of a vibrator mounted in the mobile phone (1) may cause the hard casing (2) or the board to be rubbed against the hard resin plate (12) due to vibration, thereby generating noise. In the fifth embodiment, however, the front surface of the resin plate (12) is covered with the flexible film sheet (11), and the back surface thereof is covered with the connecting portions (10*d*), so there is no fear of the casing (2) or the board from being rubbed against the resin plate (12), making it possible to prevent generation of noise.

Figure 7:
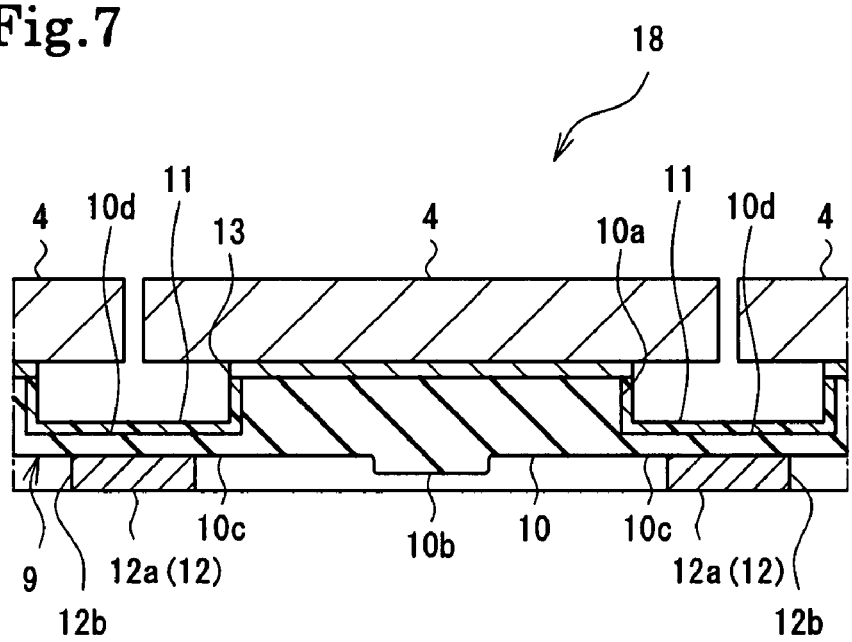
FIG. 7 is an enlarged main portion sectional view of a key sheet according to a sixth embodiment of the present invention.

Sixth Embodiment (FIG. 7)

A key sheet (18) according to the sixth embodiment differs from the key sheet (8) of the first embodiment in the construction of the rubber moldings (10). Otherwise, it is of the same construction and effects as the first embodiment.

The moldings (10) of this embodiment are provided with connecting portions (10*d*) for connecting together the rubber moldings (10), which are separated for each of the key tops (4) in the key sheet (8) of the first embodiment. The back surfaces of the connecting portions (10*d*) are fixed to the front surface of the frame portion (12*a*) of the resin plate (12).

The key sheet (18) of the fifth embodiment provides the same effects as those of the key sheet (8) of the first embodiment. Further, the key sheet (18) provides the following effects.

In the key sheet (18), the rubber moldings (10) are provided with the connecting portions (10*d*), so it is possible to increase the fixation area between the rubber moldings (10) and the film sheet (11). Thus, it is possible to increase the strength with which the moldings (10) and the film sheet (11) are fixed to each other.

Since the rubber moldings (10) are connected together by the connecting portions (10*d*), it is possible to form the rubber moldings (10) as a single sheet. Thus, as compared with the case in which the rubber moldings (10) are formed separately, they can be formed more easily.

Figure 8:
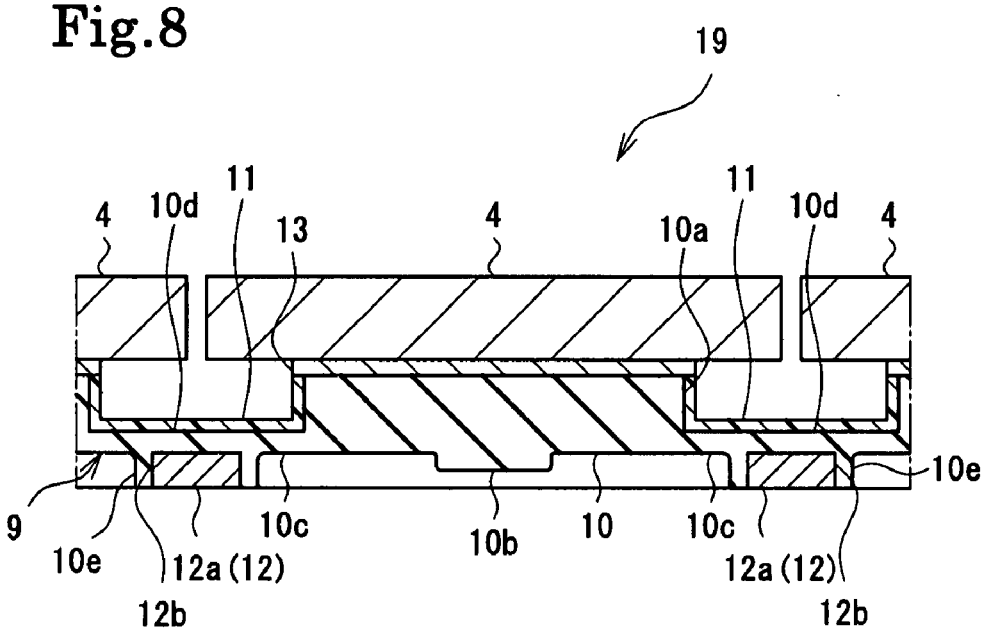
FIG. 8 is an enlarged main portion sectional view of a key sheet according to a seventh embodiment of the present invention.

Seventh Embodiment (FIG. 8)

A key sheet (19) according to the seventh embodiment differs from the key sheet (18) of the sixth embodiment in the construction of the rubber moldings (10). Otherwise, it is of the same construction and effects as the sixth embodiment.

On the back side of the rubber moldings (10), there are provided holding portions (10*e*) covering the side wall of the frame portion (12*a*) of the resin plate (12) and holding the resin plate (12).

The key sheet (19) of the seventh embodiment provides the same effects as those of the key sheet (18) of the sixth embodiment. Further, the key sheet (19) provides the following effects.

In the key sheet (19), the rubber moldings (10) are provided with the holding portions (10*e*), so it is possible to increase the fixation area between the rubber moldings (10) and the resin plate (12). Thus, it is possible to enhance the strength with which the rubber moldings (10) and the resin plate (12) are fixed to each other.

The holding portions (10*e*) exist between the float-supporting portions (10*c*) of the rubber moldings (10) and the resin plate (12), so, when the key tops (4) are depressed, it is possible to prevent the float-supporting portions (10*c*) being rubbed against the frame portion (12*a*) of the resin plate (12). Thus, it is possible to prevent breakage due to rubbing of the float-supporting portions (10*c*) against the resin plate (12).

Figure 9:
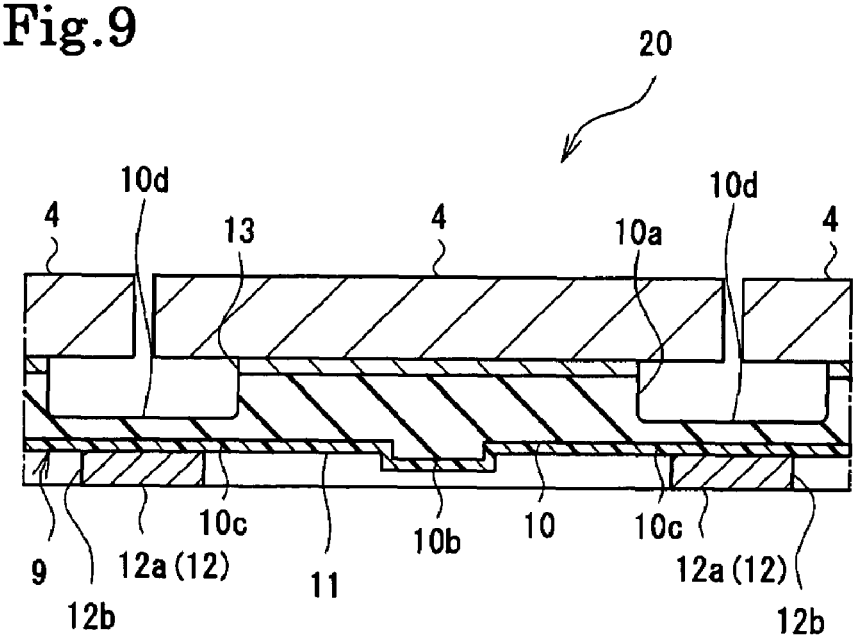
FIG. 9 is an enlarged main portion sectional view of a key sheet according to an eighth embodiment of the present invention.

Eighth Embodiment (FIG. 9)

A key sheet (20) according to the eighth embodiment differs from the key sheet (18) of the sixth embodiment in the construction of the film sheet (11). Otherwise, it is of the same construction and effects as the first embodiment.

The film sheet (11) does not exist on the surfaces of the front surfaces of the rubber moldings (10) but covers the back surfaces thereof. The surface of the frame portion (12*a*) of the resin plate (12) is fixed to the back surface of the film sheet (11). That is, the film sheet (11) exists between the connecting portions (10*d*) of the rubber moldings (10) and the frame portion (12*a*) of the resin plate (12).

The key sheet (20) of the eighth embodiment provides the same effects as those of the key sheet (18) of the sixth embodiment. Further, the key sheet (20) provides the following effects.

In the key sheet (20), the film sheet (11) covers the back surfaces of the rubber moldings (10), so, when the key tops (4) are depressed, it is possible to prevent the float-supporting portions (10*c*) of the rubber moldings (10) from being rubbed against the side wall of the frame portion (12*a*) of the resin plate (12). Thus, it is possible to prevent breakage due to rubbing of the float-supporting portions (10*c*) against the resin plate (12).

Figure 10:
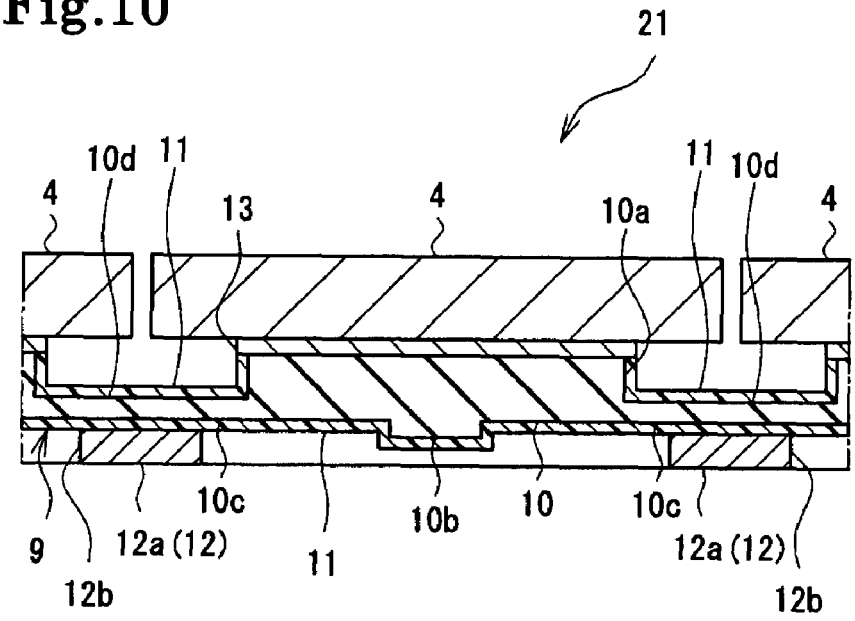
FIG. 10 is an enlarged main portion sectional view of a key sheet according to a ninth embodiment of the present invention.

Ninth Embodiment (FIG. 10)

A key sheet (21) according to the ninth embodiment differs from the key sheet (20) of the eighth embodiment in the construction of the film sheet (11). Otherwise, it is of the same construction and effects as the first embodiment.

The film sheet (11) covers both the front surfaces and the back surfaces of the rubber moldings (10).

The key sheet (21) of the ninth embodiment provides the same effects as those of the key sheet (20) of the eighth embodiment. Further, the key sheet (21) provides the following effects.

In the key sheet (21), the film sheet (11) covers the front surfaces and the back surfaces of the rubber moldings (10), so the load applied to the float-supporting portions (10*c*) when the key tops (4) are depressed is mitigated as compared with that in the above-mentioned embodiments. Thus, the float-supporting portions (10*c*) are less subject to breakage than those of the above-mentioned embodiments.

Figure 11:
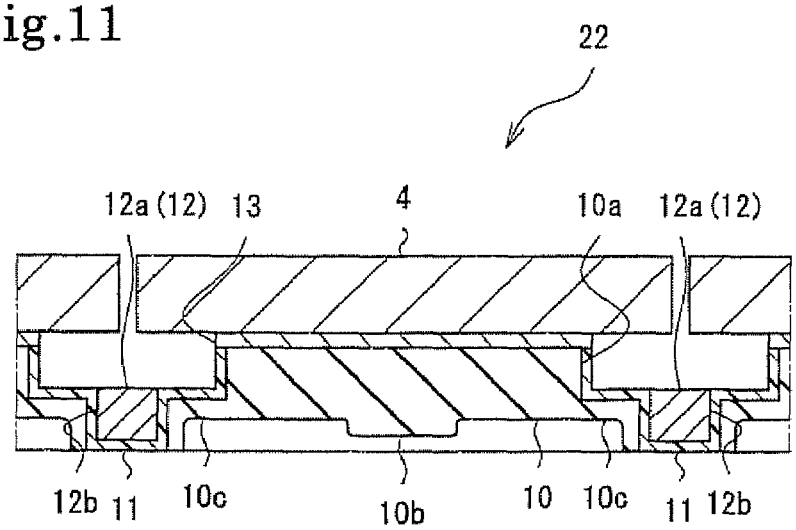
FIG. 11 is an enlarged main portion sectional view of a key sheet according to a tenth embodiment of the present invention.
Figure 12:
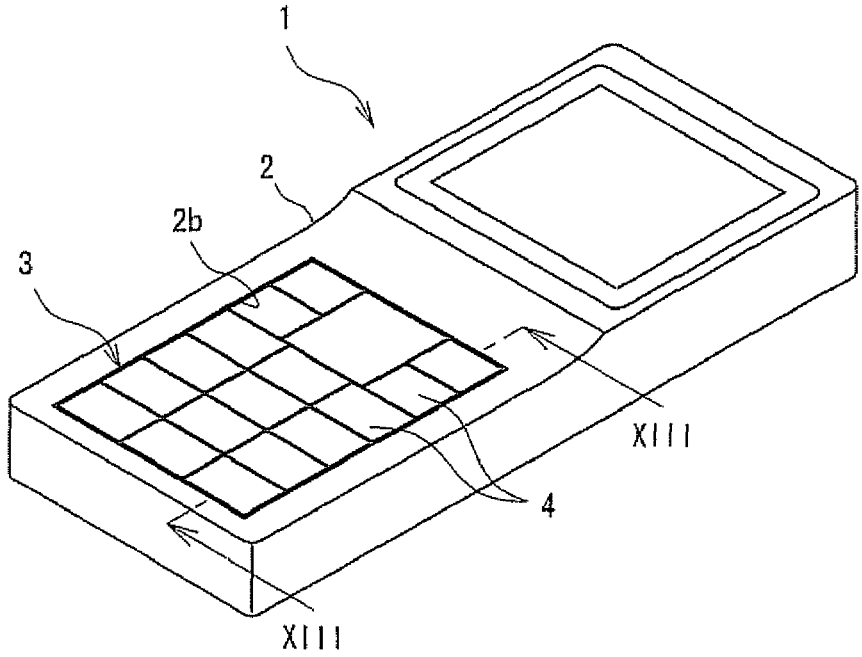
Fig.12 PRIOR ART
FIG. 12 is an external view of a mobile phone equipped with a key sheet.
Figure 13:
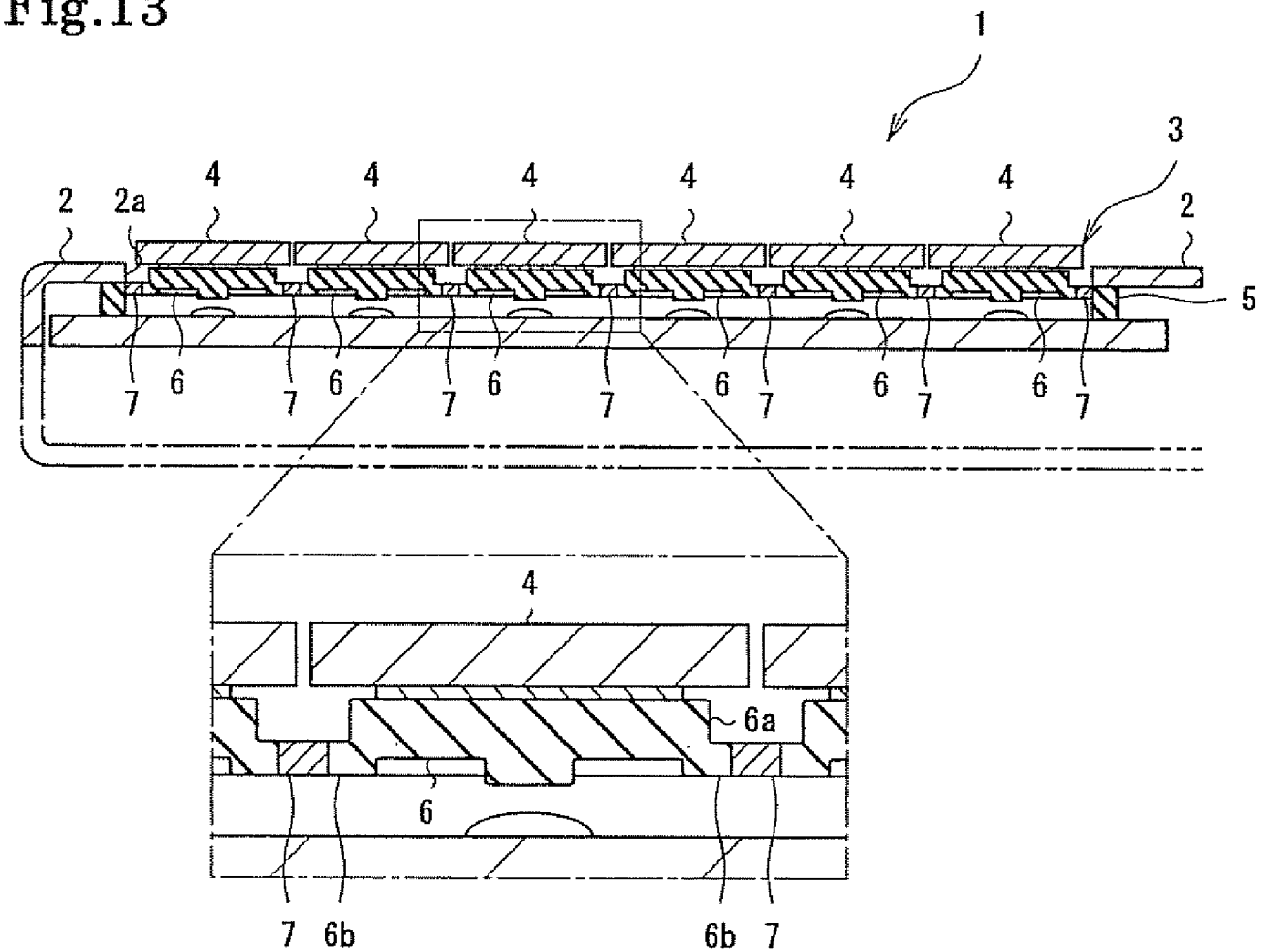
PRIOR ART Fig.13
FIG. 13 is a sectional view taken along the line XII-XII of FIG. 12.

Tenth Embodiment (FIG. 11)

A key sheet (22) according to the tenth embodiment differs from the key sheet (8) of the first embodiment in the constructions of the rubber moldings (10) and the adhesion layers (13). Otherwise, it is of the same construction and effects as the first embodiment.

The rubber moldings (10) are formed of a styrene type thermoplastic elastomer, and are formed separately for each of the key tops (4) as in the first embodiment. The key tops (4) are fixed to the top surfaces of the pedestal portions (10*a*) of the rubber moldings (10) by the adhesion layers (13) formed of a hot-melt adhesive which is softened or melted through heating.

The key sheet (22) of the tenth embodiment provides the same effects as those of the key sheet (8) of the first embodiment. Further, the key sheet (22) provides the following effects.

The hot-melt adhesion layers can be provided in alignment with the upper surfaces of the pedestal portions (10*a*) of the rubber moldings (10) by utilizing heat transfer, so the adhesion layers (13) can be provided in conformity with the fixation area and the fixation configuration of the key tops (4). Thus, it is possible to prevent adhesion of squeezed-out adhesive from the adhesion layers (13) to the float-supporting portions (10*c*), making the float-supporting portions (10*c*) relatively free from breakage. Further, unlike adhesion layers formed by applying liquid adhesive, the adhesion layers (13) formed of hot-melt adhesive do not trap air therein. Thus, when the key sheet (22) is illuminated by a backlight, the key tops (4) are illuminated uniformly without involving unevenness.

Other Embodiments

The features of the above-mentioned embodiments are also applicable to other embodiments. For example, it is also possible for the film sheet (11) to cover the upper surfaces of the pedestal portions (10*a*) of the rubber moldings (10) of the second and fifth through tenth embodiments (i.e., surfaces to which key tops (4) are fixed). In another example, it is possible to cover the back surfaces of the rubber moldings (10) of the above-mentioned seventh embodiment with the film sheet (11).

While in the above-mentioned embodiments the film sheet (11) constitutes the "protective layer", it is also possible, for example, to adopt a coating layer formed through application.

In the above-mentioned embodiments, it is also possible to form display print layers in the form of characters or hollow characters on the upper surfaces or bottom surfaces of the key tops (4) or on the film sheet (11).

While in the above-mentioned embodiments the resin plate (12) is adopted as the "reinforcing member", it is also possible to adopt, for example, a metal plate of stainless steel, or aluminum.

Further, in the above-mentioned embodiments, it is possible to form the resin plate (12) as the "reinforcing member" and the film sheet (11) of transparent materials, thus providing a light guide function enabling the light from the illumination light source to be guided to the key tops (4). Further, for example, in the first, second, fifth, sixth, seventh, and tenth embodiments, it is possible to make the film sheet (11) lightproof, to make the key tops (4) translucent, and to form thereon display print layers in the form of characters or hollow characters, whereby it is possible to provide an illumination type key sheet which is free from light leakage through the gaps between the adjacent key tops (4) and in which the key tops (4) are brightly illuminated. When the film sheet (11) is formed as a colored member, whether translucent or lightproof, it is possible to attain an artistic design effect due to the color visible through the gaps between the adjacent key tops (4).

While in the above-mentioned embodiments the present invention applied to a so-called "small-interval key sheet", it may also be applied to a key sheet of the type which is incorporated into the casing (2) with a partition frame.

What is claimed is:

1. A key sheet, comprising:

a key top; and a base sheet having a support member formed of a rubber-like elastic material and including a fixation portion for the key top and a float-supporting portion allowing depression displacement of the key top, and a reinforcing member supporting the support member and formed like a thin board of a hard material, wherein the float-supporting portion is equipped with a flexible protective layer.

2. A key sheet according to claim 1, wherein the protective layer exists between the support member and the reinforcing member.

3. A key sheet according to claim 1, wherein the protective layer is provided on a front surface of the support member.

4. A key sheet according to claim 1, wherein the protective layer is provided on a back surface of the support member.

5. A key sheet according to claim 1, wherein the protective layer is provided on a front surface and a back surface of the support member.

6. A key sheet according to claim 1, wherein the protective layer covers a surface of the fixation portion of the support member.

7. A key sheet according to claim 1, wherein the reinforcing member is equipped with a frame portion supporting the float-supporting portion, and wherein the support member is equipped with a holding portion covering a side wall of the frame portion.

8. A key sheet according to claim 1, wherein the protective layer is formed of a soft resin.

9. A key sheet according to claim 1, wherein the protective layer is formed of a thermoplastic resin.

10. A key sheet according to claim 9, wherein the key top is formed of a thermoplastic resin, and wherein the key top is fixed to the protective layer covering a surface of the fixation portion through one of softening and melting.

11. A key sheet according to claim 1, wherein the key top is fixed to the protective layer by an adhesion layer that undergoes one of softening and melting by heating.

12. A key sheet according to claim 1, wherein the key top is fixed to the support member by an adhesion layer that undergoes one of softening and melting by heating.

* * * * *